US006762688B2

(12) United States Patent
Johnston et al.

(10) Patent No.: US 6,762,688 B2
(45) Date of Patent: Jul. 13, 2004

(54) DEVICE WITH SILENCING CIRCUITRY

(75) Inventors: Derek Scott Johnston, Aurora, IL (US); Vincent B. Mori, Tinley Park, IL (US); Edward C. Duran, Warrenville, IL (US); Kenneth L. Venzant, Bolingbrook, IL (US)

(73) Assignee: BRK Brands, Inc., Aurora, IL (US)

( * ) Notice: Subject to any disclaimer, the term of this patent is extended or adjusted under 35 U.S.C. 154(b) by 0 days.

(21) Appl. No.: 10/071,267

(22) Filed: Feb. 8, 2002

(65) Prior Publication Data

US 2002/0130782 A1 Sep. 19, 2002

Related U.S. Application Data

(60) Provisional application No. 60/269,514, filed on Feb. 16, 2001.

(51) Int. Cl.[7] ..... G08B 17/10

(52) U.S. Cl. ..... 340/628; 340/635; 340/636.1; 340/693.6; 340/693.7

(58) Field of Search ..... 340/628, 629, 340/630, 632, 633, 634, 635, 636, 693.6, 693.7

(56) References Cited

U.S. PATENT DOCUMENTS 4,088,986 A * 5/1978 Boucher ..... 340/521
4,176,346 A 11/1979 Johnson et al.
4,231,249 A * 11/1980 Zuckerman ..... 73/31.03
4,313,110 A * 1/1982 Subulak et al. ..... 340/527
4,688,021 A * 8/1987 Buck et al. ..... 340/521
4,901,056 A 2/1990 Bellavia et al.
5,524,099 A * 6/1996 Rickman et al. ..... 367/13
5,786,768 A * 7/1998 Chan et al. ..... 340/632
5,798,700 A 8/1998 Wong
5,801,633 A 9/1998 Soni
5,818,326 A 10/1998 Winterble et al.
5,867,105 A 2/1999 Hajel
5,905,438 A * 5/1999 Weiss et al. ..... 340/636
5,936,533 A 8/1999 Bernal et al.
5,966,079 A 10/1999 Tanguay
6,081,197 A * 6/2000 Garrick et al. ..... 340/636
6,144,310 A 11/2000 Morris
6,522,248 B1 2/2003 Andres et al.

OTHER PUBLICATIONS

Notification of Transmittal of The International Search Report or the Declaration received Jul. 3, 2002 and mailed Jun. 27, 2002 from the counterpart PCT application.

* cited by examiner

*Primary Examiner*—Daniel J. Wu
*Assistant Examiner*—Son Tang
(74) *Attorney, Agent, or Firm*—Welsh & Katz, Ltd.

(57) ABSTRACT

A smoke detector monitors one or more internal conditions, such as battery output voltage in detectors that include batteries. Both audible and visible indicators are energized to indicate the presence of the monitored condition or conditions. A switch or a wireless sensor on the detector can be actuated to temporarily suppress the audible indicator provided the battery exhibits an output voltage in a predetermined range, less than that of normal operation.

4 Claims, 2 Drawing Sheets

DEVICE WITH SILENCING CIRCUITRY

This Utility Application claims the benefit of Provisional Application Ser. No. 60/269,514, filed Feb. 16, 2001.

FIELD OF THE INVENTION

The invention pertains to electrical devices which contain monitoring circuitry wherein such circuitry emits audible warning signals that a parameter which has been monitored is exhibiting a trouble indicator. More particularly, the invention pertains to ambient condition detectors which contain internal monitoring circuitry and which also contain circuits for silencing an audible indicator which is indicating that a monitored condition needs attention or service.

BACKGROUND OF THE INVENTION

Smoke detectors which contain alarm silencing circuitry are known. Such circuitry makes it possible to temporarily silence a detector which has gone into alarm due to a non-hazardous condition. Such conditions include stray smoke due to cigarettes, cigars or cooking. In known detectors, a user in the immediate area can depress a button or switch on the detector and temporarily silence an audible alarm in the presence of such nuisance conditions.

As an alternate to manually actuating a switch on a detector, systems are known for remotely suppressing nuisance alarms temporarily. One such system and method is disclosed in Bellavia et al U.S. Pat. No. 4,901,056.

Nuisance alarm conditions usually are initiated by exterior ambient conditions which are being sensed. Known detectors also monitor internal conditions which include, for battery powered detectors, battery energy levels. Where the monitored condition exhibits an out of range condition, such as a low battery, low battery audio and visible indicators can be energized.

Despite their informational value, such audible indicators can also be a nuisance. This is particularly the case where an out of range condition occurs at night when the people in the immediate area may not be able to alleviate the condition.

There continues to be a need for electrical units which monitor internal operational conditions where alarms associated therewith can be temporarily silenced. It would be especially desirable in such silencing circuitry did not appreciably add to cost or manufacturing complexity.

SUMMARY OF THE INVENTION

An ambient condition detector includes a housing and at least one ambient condition sensor carried by the housing. Control circuitry, which could include a programmed processor, is coupled to the sensor and includes circuits and/or executable instructions to determine if an alarm has been sensed.

The control circuitry also includes monitoring circuitry. The monitoring circuitry monitors one or more internal conditions apart from the one or more ambient conditions that are normally monitored. Examples include monitoring power supply or battery performance or output, and monitoring sensor performance to determine if the sensor, or sensors, exhibit acceptable clear air outputs. Other conditions can also be monitored.

In one aspect, for example, the detector includes manually activatable suppression circuitry which can be used to temporarily suppress a low power indicator produced by the monitoring circuitry provided that the element being monitored falls within one of at least three operational regions.

Such indicators can be verbal or visible. The suppression circuitry can temporarily suppress either or both indicators. Other conditions can also be monitored and suppressed.

The sensor will continue to monitor the ambient while the condition indicator is suppressed. An alarm condition will be promptly reported even in the presence of a suppressed indicator.

The control circuitry can include an analog-to-digital converter for producing binary representations of condition indicating signals. The binary signals can be compared to a plurality of values in accordance with a pre-stored control program.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
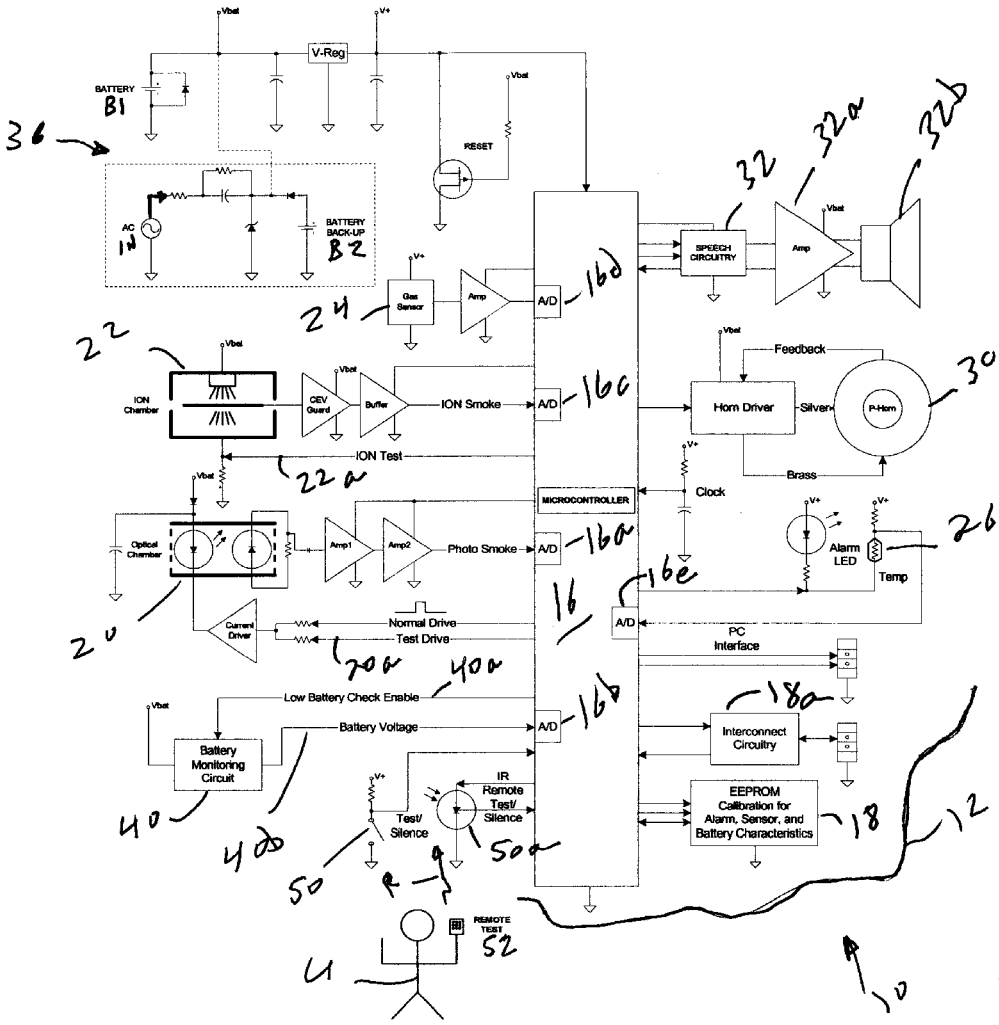
FIG. 1 is a block diagram of a detector in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 is a block diagram of a substantially self-contained detector 10 in accordance with the present invention. The detector 10 is contained within a housing 12 and could be mounted on a wall or a ceiling as would be understood by those of skill in the art. Detector 10 includes control circuitry which could be implemented in part by a programmed processor 16 which incorporates stored, executable instructions for carrying out control processes described subsequently.

Detector 10 can include one or more ambient condition sensors such as optical or photoelectric smoke sensor 20, ionization smoke sensor 22, gas sensor 24, and thermal sensor 26. The sensors 20–26 are advantageously coupled to processor 16 by one or more analog-to-digital converter circuits such as circuit 16*a*.

Detector 10 incorporates audible output devices such as a horn 30 which could be implemented as a piezoelectric element as would be understood by those of skill in the art. Alternately, or in addition, speech output circuitry 32 can be incorporated. Circuitry 32 can be coupled via amplifier 32*a* to speaker 32*b*.

The detector 10 can be energized using a replaceable battery such as battery B1. Alternately, the detector 10 can be powered off of the utility supplied AC electrical energy by an AC/DC supply generally indicated at 36. The supply 36 can incorporate battery back-up B2.

The detector 10 can incorporate programmable read only memory (EEPROM)18 for storage of calibration constants such as for storage of battery characteristics, alarm characteristics or sensor characteristics. The programmable read only memory 18 is particularly advantageous in that various sensors or batteries can be combined in the detector 10 without having to make hardware changes. Rather, the characteristics of various sensors, alarms and batteries can be loaded in programmable memory 18 for use by the pre-stored control program in processor 16.

Detector 10 also incorporates battery monitoring circuitry 40 of a type which would be understood by those of skill in the art. Circuitry 40 can, in response to enable commands, line 40*a* from processor 16, impose a load on the battery such as battery B1 or B2 for purposes of monitoring same. A loaded battery voltage can be fed back via line 40*b* digitized in analog-to-digital converter 16*b* and then processed as described subsequently with respect to processing of FIG. 2.

Sensors such as sensor 20, 22, 24 and 26 can also be tested via processor 16, for example via line 20*a* or line 22*a*. Results of such testing can be fed back to processor 10 via analog to digital converter 16*a*, 16*c* 16*d* or 16*e* for comparison to pre-stored sensor calibration constants available via programmable memory 18. The condition of the various sensors can be evaluated and processor 16, as is the case with condition of monitored batteries such as B1 or B2, can output audible or visible indicators of sensor out of range, low battery or the like such that a user U can be made aware that detector 10 requires maintenance or attention.

User U can communicate with detector 10 via test/silence switch 50. A manually actuatable member for switch 50 can be made available on housing 12 for the convenience of the User U. Alternately, where the detector 10 is mounted at a ceiling location or other location which his inconvenient for the user to reach, a remote test initiation unit 52 can be used as a source of radiant energy R to initiate a test or condition indicator silencing function as discussed subsequently.

Those of skill will understand that processor 16 carries out processing to monitor and access the outputs from sensors from 20 through 26 and a local determination of an alarm condition can be made within detector 10, a substantially self-contained unit. Interconnect circuitry 18*a* can be used to interconnect and/or power a plurality of detectors 10 without any need for a control panel, as would be understood by those of skill in the art.

One advantageous aspect of detector 10 is found in the ability of a user U to silence an audible indication that battery B1 or B2 should be replaced. This silencing process can only be carried out where the loaded output voltage, or other measured parameter, from the respective battery B1, B2 falls within a predetermined range out of a normal operating range and also outside of a range which is indicative of the need to replace the respective battery B1, B2 promptly.

Figure 2:
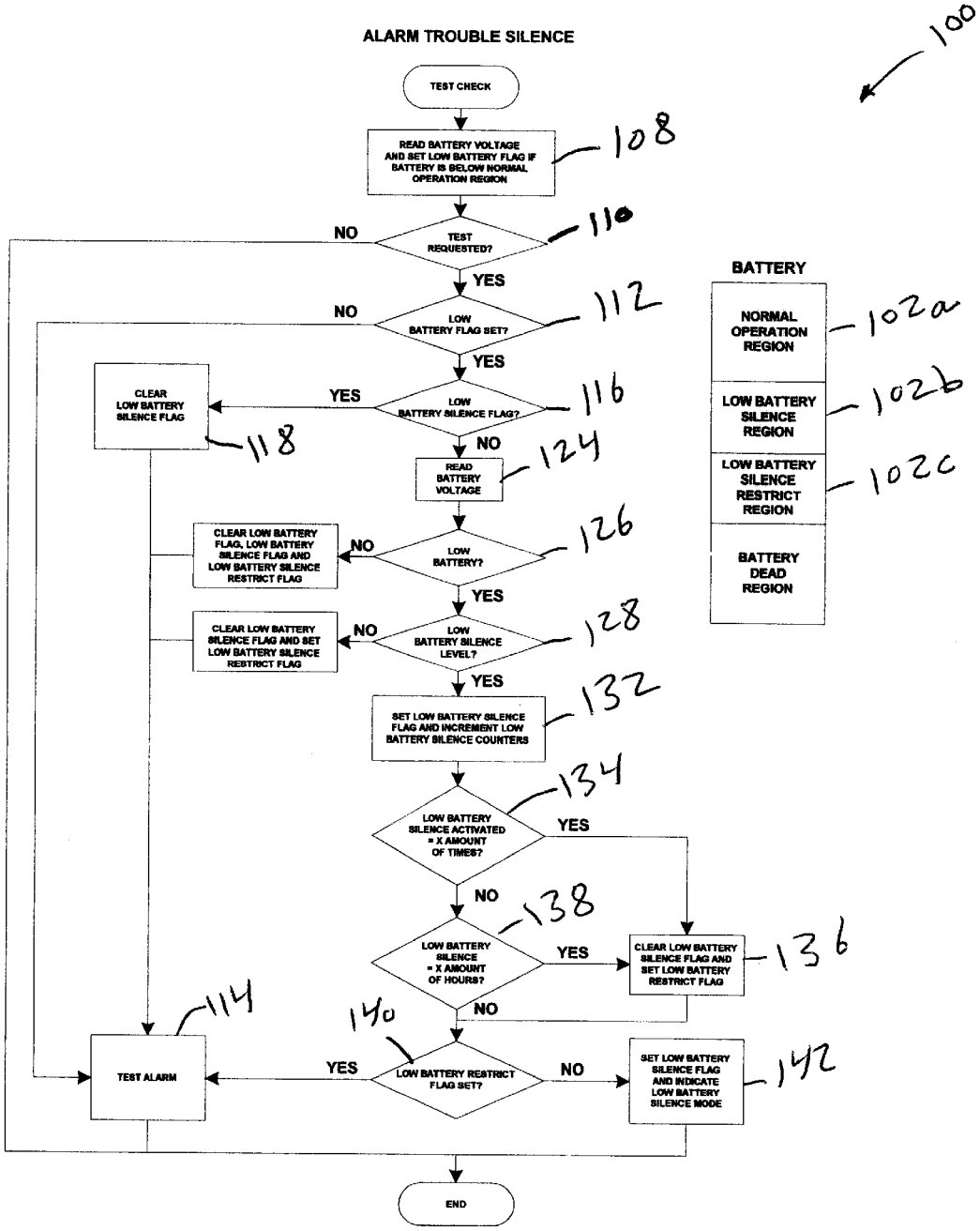
FIG. 2 is a flow diagram illustrating the various aspects of a method in accordance with the present invention.

FIG. 2 illustrates processing steps 100 carried out by processor 16 in monitoring an exemplary sensor parameter, apart from evaluating the sensor output for an alarm condition, or evaluating an operational parameter for battery B1 or B2 such as battery voltage. For exemplary purposes, and not limitation, processing steps 100 are directed to a battery monitoring process.

Battery output under loaded conditions is accessed relative to three different regions. Region 102*a* corresponds to battery output, when loaded for test purposes, indicative of a normal operation.

Battery output region 102*b* is indicative of a battery condition wherein the respective battery should be replaced. In this region, detector 10 will under normal operating conditions emit an audible and/or visible indication that battery B1 or B2 should be replaced. Region 102*b* corresponds to an operating region wherein the audible battery replacement indicator can be temporarily silenced for a period of time, for example several days, to enable the user U to obtain and install a replacement battery.

The low battery silence restrict region 102*c* corresponds to a region wherein the monitored battery parameter, under load, has fallen to a lower value than region 102*b*. When the respective battery, such as B1 or B2, exhibits an output in region 102*c*, the audible indicator that the respective battery should be replaced can no longer be suppressed. Instead, processor 16 periodically drives the audible output circuitry, either a horn 30 or speaker 32*b* to provide an audible indication that the respective battery should be replaced.

In step 108, loaded battery voltage is checked. If not in the normal operating region 102*a*, a low battery flay is set.

In step 110, the condition of switch 50 or 50*a* is checked to determine whether or not the user U has requested a test/silence function either by depressing switch 50 or by using remote test unit 52 to generate a beam of radiant energy R to actuate switch 50*a*. If the answer is affirmative, a low battery check is made at step 112. If a test has been requested, step 110, and there is no low battery condition, step 112, the alarm will be tested step 114.

Where a low battery condition has been sensed, the low battery silence flag is checked step 116. If set, the flag is cleared, step 118 and the alarm is tested, step 114. If the low battery silence flag has not been set, the battery voltage is read step 124, and in the event that there is a low battery condition, step 126, and the battery is exhibiting an output in the low battery silence region 102*b*, step 128, the low battery silence flag will be set and the low battery silence counters, for example day and hour counters, are incremented step 132.

In step 134, a determination is made as to whether the low battery silence function has been actuated X times. If so, in step 136, the low battery silence flag is cleared and the low battery restrict flag is set, step 136. Alternately, the number of hours is checked step 138 wherein the low battery indicator has been silenced.

Subsequently, step 140, a check is made as to whether the low battery restrict flag has been set. If yes, the alarm is tested, step 114. If it has not been set in step 142, the low battery silence flag is set and the low battery silence mode is indicatable audibly and visibly. Process 100 is then exited by processor 16.

In accordance with the above-described processing, an audible indicator of the low battery condition can be suppressed for either a predetermined period of time or a predetermined number of suppressions of the low battery indicator function provided the low battery condition falls within the low battery silence region, 102*b*. In the alternative, where the battery output falls within the low battery silence restrict region 102*c*, the audible/visible indicators thereof can not be suppressed. Comparable processing can be carried out for purposes of monitoring sensor condition directed to a non-alarm parameter. Representative non-alarm parameters associated with the sensors could include ambient sensor output in the absence of smoke or gas, for example, too high or too low. Similarly, ambient output from the temperature sensor in the absence of extreme temperature can be monitored for being too high or too low and appropriate audible/visible indicators thereof can be provided. Such indicators can be temporarily suppressed for user convenience during certain predetermined regions of parameter value.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A detector comprising:

first and second different ambient condition sensors;

a control circuit which includes programmed instructions for digitally implementing a sensing function for each of the sensors;

first and second test circuits wherein each test circuit tests a respective sensor;

at least one circuit for monitoring an internal operational characteristic of each sensor and wherein the control circuit includes instructions for evaluating a digital representation of the operational characteristics;

a calibration storage unit coupled to the control circuit wherein initial performance information can be pre-stored to take into account component variations wherein a verbal output can be generated by the control circuit indicative of the sensed, non-alarm operational characteristic and which includes actuation circuitry for suppressing the verbal output for a predetermined period of time.

2. A detector as in claim 1 wherein the actuation circuitry includes a wireless input port for receipt of a remotely generated suppression signal.

3. A detector as in claim 1 wherein the sensors are selected from a class which includes fire sensors and gas sensors.

4. A detector comprising:

first and second different ambient condition sensors;

a control circuit which includes programmed instructions for digitally implementing a sensing function for each of the sensors;

first and second test circuits wherein each test circuit tests a respective sensor;

at least one circuit for monitoring an internal operational characteristic and wherein the control circuit includes instructions for evaluating a digital representation of the operational characteristic;

a calibration storage unit coupled to the control circuit wherein initial performance information can be pre-stored to take into account component variations wherein a verbal output can be generated by the control circuit indicative of a variation between the digital representation of the operational characteristic and selected initial performance information.

* * * * *